US006821217B2

(12) United States Patent
Squibb

(10) Patent No.: US 6,821,217 B2
(45) Date of Patent: Nov. 23, 2004

(54) PORTABLE BASKETBALL UNIT

(75) Inventor: Neal C. Squibb, Jefferson, IA (US)

(73) Assignee: American Sports International, LTD, Jefferson, IA (US)

( * ) Notice: Subject to any disclaimer, the term of this patent is extended or adjusted under 35 U.S.C. 154(b) by 159 days.

(21) Appl. No.: 09/934,728

(22) Filed: Aug. 22, 2001

(65) Prior Publication Data

US 2003/0040383 A1 Feb. 27, 2003

(51) Int. Cl.[7] ..... A63B 63/08
(52) U.S. Cl. ..... 473/481
(58) Field of Search ..... 473/481, 482, 473/483, 479, 476, 484, 472

(56) References Cited

U.S. PATENT DOCUMENTS 1,013,685 A * 1/1912 Reach ..... 482/25
2,348,869 A * 5/1944 Wagner ..... 254/420
3,427,025 A * 2/1969 Procter ..... 473/483
4,412,679 A * 11/1983 Mahoney et al. ..... 473/483
5,628,508 A * 5/1997 Koole ..... 473/481
5,947,848 A * 9/1999 Koole ..... 473/483

* cited by examiner

*Primary Examiner*—Gregory Vidovich
*Assistant Examiner*—M. Chambers

(57) ABSTRACT

A portable basketball unit with a base, moveable support frame members rotatably connected to the base for movement between an upper position and a lower transport position, a beam supporting a backboard and rim member moveably connected to the support frame members, forward wheels with a means for retracting the wheels when the support frame members are in an upper position, and a means for moving the wheels downwardly when the support frame members are in a lower transport position.

5 Claims, 4 Drawing Sheets

PORTABLE BASKETBALL UNIT

BACKGROUND OF THE INVENTION

Basketball units that are capable of being raised and lowered are known in the art. An example is the device shown in U.S. Pat. No. 5,628,508 by Koole. These units, which are large and heavy, are used by college and professional teams because they can be transported and stored when other events are scheduled in the arena.

Present units, however, are complicated in their design and require many parts to prepare the basketball unit for transport. Therefore, a need exists for a portable basketball unit that is simple to operate and more easy to construct.

BRIEF SUMMARY OF THE INVENTION

The objective of the present invention is to provide a device that is easy to manufacture, having a minimum number of parts.

A further objective of the present invention is to provide a device that is simple to operate and transport.

A still further objective of the invention is to provide a device that is economical to manufacture.

The present invention has a base that is supported on a surface by a pair of rear wheels and front foot members. Rotatably connected to the base are support frame members that are capable of movement between an upper position and a lower transport position. A swing arm is pivotally connected between the support members. A beam supporting a backboard and rim member are movably connected to support members. A pair of forward wheels are mounted on the base and have a retractable means for maintaining the wheels in a raised position when the support members are in the upper position. Finally, there is a means for moving the forward wheels downwardly, which in turn raises the foot pads off the support surface, allowing the basketball unit to be moved longitudinally over the support surface.

These and other objectives, features, and advantages of the present invention will become apparent to one skilled in the art upon reading the following detailed description in view of the drawings.

DETAILED DESCRIPTION OF THE PREFERRED EMBODIMENT

Figure 1:
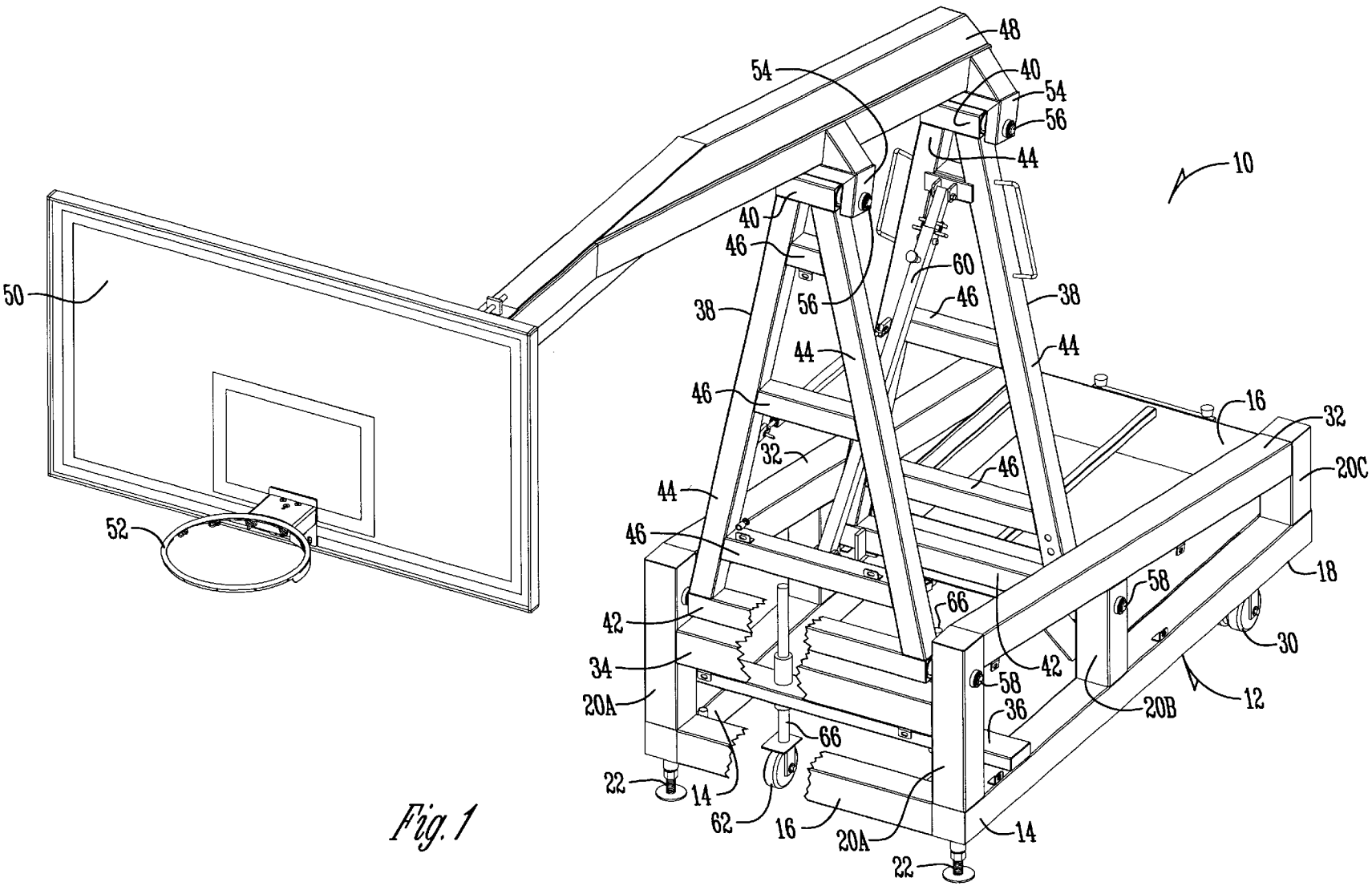
FIG. 1 is a perspective view of the portable basketball unit.
Figure 3:
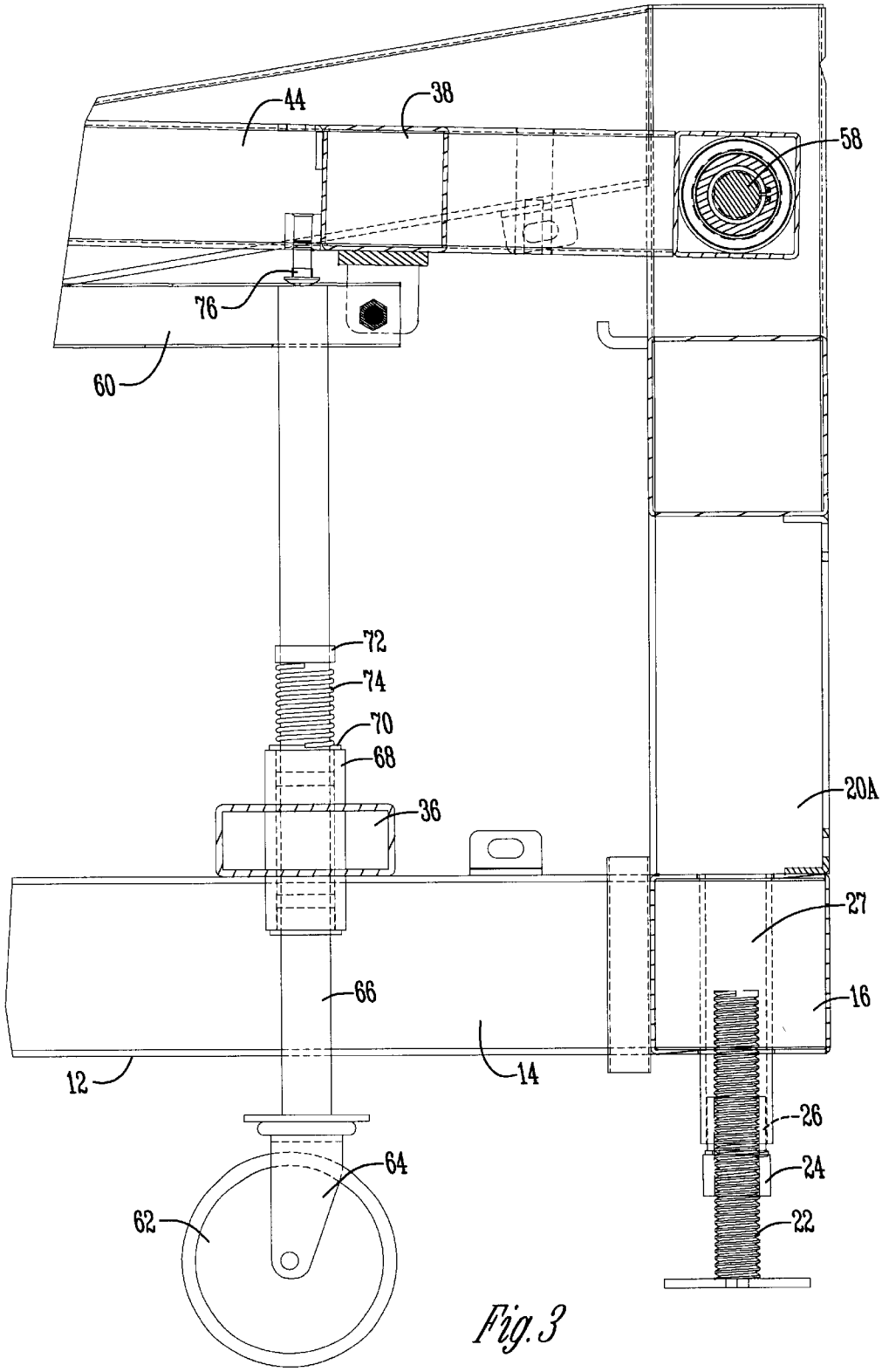
FIG. 3 is an enlarged side view of the basketball unit in a lowered position.

Referring to the drawings, the portable basketball rim unit is referred to generally by reference numeral 10. The basketball unit 10, as shown in FIG. 1, has a base 12 with two lower longitudinal members 14 and two lower perpendicular members 16 connected at their ends to generally form a rectangular lower base section 18. Extending upwardly from the lower base section 18 are forward, middle, and rearward vertical members, 20A, 20B, and 20C, respectively. Extending downwardly from the lower section 18 at the forward ends of the lower longitudinal members 14 are a pair of foot pads or foot members 22. As best shown in FIG. 3, the foot members 22 extend through and are threadably received by a locking nut 24 and into a threaded sleeve 26 positioned in a bore 27 in the forward end of the lower longitudinal members 14. This structure allows the foot member 22 to be adjusted and maintained at a desired height. Mounted toward the rearward ends of the lower longitudinal members 14 are a pair of rearward wheels 30.

Upper longitudinal members 32 are positioned above the lower longitudinal members 14 in spaced relation and are connected between the forward and rearward vertical members 20A and 20C, respectively, and above the middle vertical member 20B. A bracing member 34 is positioned above the forward lower perpendicular member 16 and connected between the forward vertical members 20A. Finally, a frame member 36 is connected to a top surface of the lower longitudinal members 14 between the forward 20A and middle 20B vertical members.

Extending upwardly from the base 12 are a pair of moveable support frame members 38 that have an upper bearing block 40 and a lower bearing block 42. Two diagonally vertical frame beams 44 are connected between the upper bearing block 40 and the lower bearing block 42, and brace members 46 are connected between the vertical frame beams 44.

Figure 2:
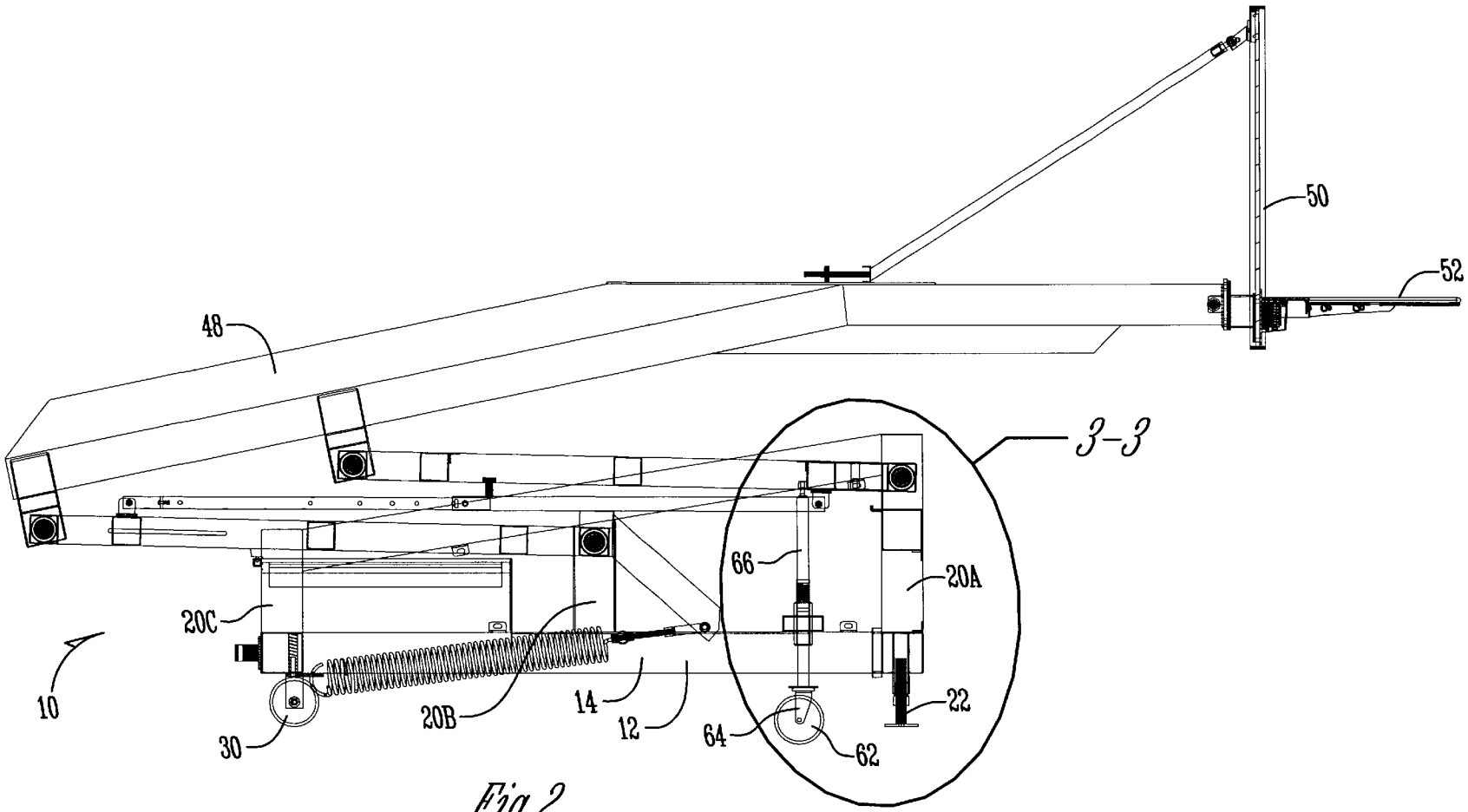
FIG. 2 is a side view of the basketball unit in a lowered transport position.

A beam 48 supports a backboard 50 and a rim 52. The beam 48 also has a pair of brackets 54 that extend below the beam and are moveably connected to the upper bearing blocks 40 of the support frame members 38 by pivot pins 56 that extend through the brackets 54 into the upper bearing blocks 40. The lower bearing blocks 42 are moveably connected to the forward vertical member 20A and the middle vertical member 20B of the base 12 by lower pivot pins 58. Extending between the support frame members 38 is a swing arm 60 that is pivotally connected between the lower brace member 46A of the forward support frame member and the upper brace member 46B of the rearward support frame member. The swing arm 60 helps to maintain the support frame members 38 in an upper position as shown in FIG. 1, and assists in moving the support frame members 38, as they rotate about the upper and lower bearing blocks 40, 42, to a lower transport position as shown in FIG. 2.

Figure 4:
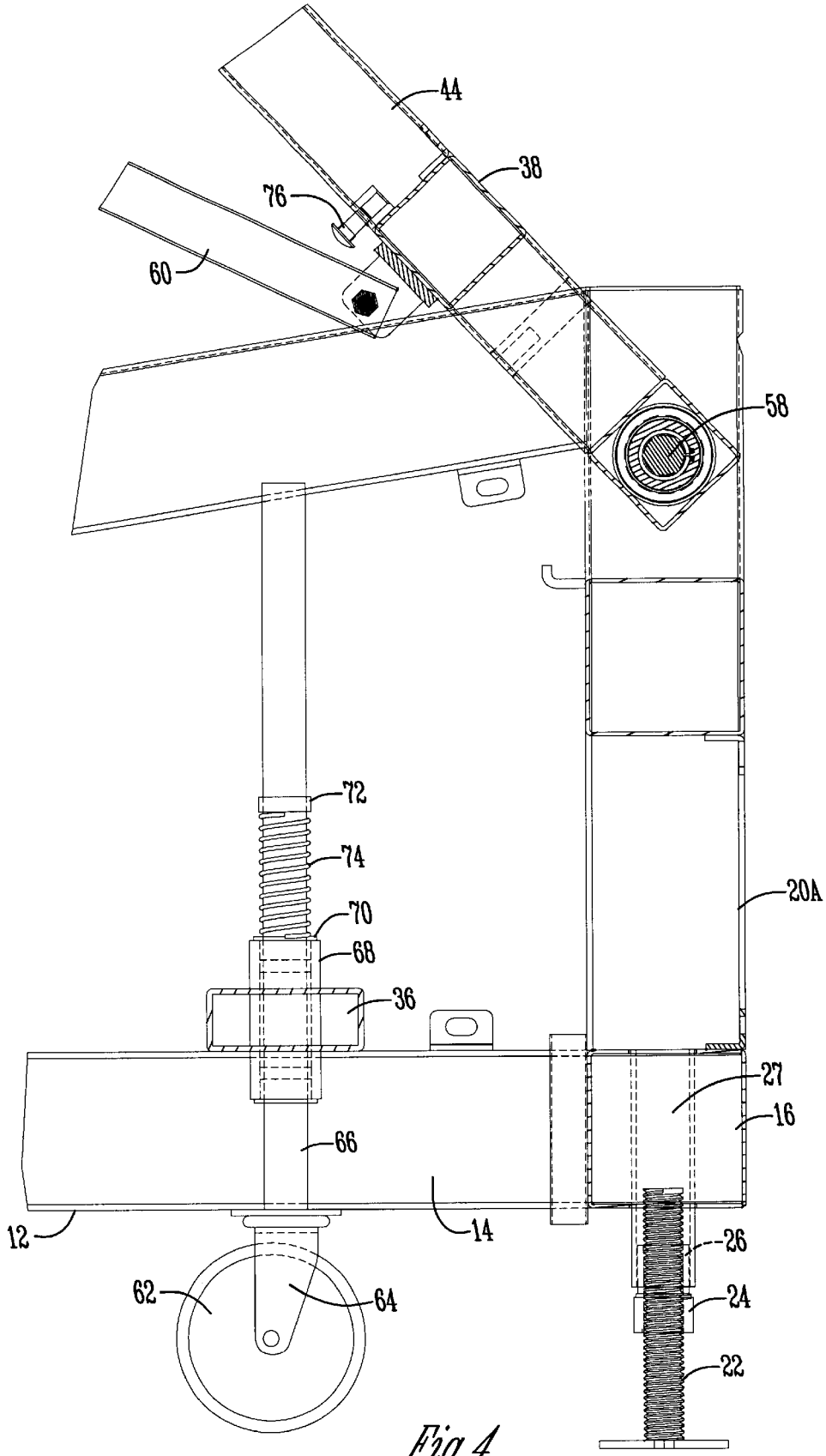
FIG. 4 is an enlarged side view of the basketball unit in an upper position.

Referring now to FIGS. 3 and 4, mounted on frame member 36 are retractable forward wheels 62. The wheels 62 are connected to castors 64 that pivots about a vertical shaft 66 that extends upwardly through the frame member 36. Extending through and rigid with the frame member is a sleeve 68 that slideably receives the vertical shaft 66. Mounted to the top of the sleeve 68 is a washer plate 70 with a central opening with a diameter less than the sleeve 68. Rigid with the shaft 66, and positioned above the washer plate 70, is a retaining washer 72. Between the retaining washer 72 and the washer plate 70 is an expandable spring 74 that surrounds the shaft 66. When the basketball unit 10 is in an upper position, the spring 74 is in an expanded state, which exerts an upward force against the retaining washer 72, which in turn raises the vertical shaft 66 causing the forward wheel 62 to retract. See FIG. 4.

When the basketball unit 10 is in a lowered transport position, the forward support member 38 moves from an upper position, see FIG. 1, to a generally horizontal position. See FIG. 3. Connected to the forward support frame member 38 is an adjustable screw 76. The screw 76 contacts the vertical shaft 66 and moves the shaft in a downward direction. As the shaft moves downwardly, the spring 74 is compressed, and the forward wheel 62 moves downwardly until it engages the support surface. See FIGS. 2 and 3. As the wheels 62 engage the support surface and the vertical shaft 66 slides through the sleeve 68 of the frame member 36, the base 12 is raised along with the foot members 22, which allows the basketball unit 10 to be moved longitudinally over the support surface. See FIG. 3.

As can be seen by the foregoing disclosure, the portable basketball unit of this invention accomplishes its objectives, including providing a simple and easy device for transporting a basketball unit.

Having described the preferred embodiment, it will become apparent that various modifications can be made without departing from the scope of the invention as defined in the accompanying claims.

What is claimed is:

1. A portable basketball unit comprising:

a base extending generally parallel to a support surface and supported by a pair of rear wheels and a pair of foot members;

moveable support frame members rotatably connected to the base for movement between an upper position and a lower transport position;

a beam supporting a backboard and rim member moveably connected to the support frame members;

forward wheels mounted on the base with a retractable means for maintaining the wheels in a raised position in relation to the base such that the forward wheels are automatically raised by the retractable means when the support members are in the upper position; and a means for moving the forward wheels downwardly in relation to the base, such that the forward wheels engage the support surface when the support members are in the lower transport position, such that the foot members are raised off the support surface, and the basketball unit is capable of longitudinal movement over the support surface.

2. A portable basketball unit comprising:

a base extending generally parallel to a support surface and supported by a pair of rear wheels and a pair of foot members;

moveable support frame members rotatably connected to the base for movement between an upper position and a lower transport position;

a beam supporting a backboard and rim member moveably connected to the support frame members;

forward wheels mounted on the base with a retractable means for maintaining the wheels in a raised position in relation to the base when the support members are in the upper position; and a means for moving the forward wheels downwardly in relation to the base, such that the forward wheels are automatically moved downward by the means for moving the forward wheels downwardly to engage the support surface when the support members are in the lower transport position, such that the foot members are raised off the support surface, and the basketball unit is capable of longitudinal movement over the support surface.

3. A portable basketball unit comprising:

a base extending generally parallel to a support surface and supported by a pair of rear wheels and a pair of foot members;

moveable support frame members rotatably connected to the base for movement between an upper position and a lower transport position;

a beam supporting a backboard and rim member moveably connected to the support frame members;

forward wheels connected to a vertical shaft that extends through the base with a retractable means for maintaining the wheels in a raised position in relation to the base when the support members are in the upper position; and a means for moving the vertical shaft and forward wheels downwardly in relation to the base, such that the forward wheels engage the support surface when the support members are in the lower transport position, such that the foot members are raised off the support surface, and the basketball unit is capable of longitudinal movement over the support surface.

4. The device of claim 3 wherein the forward wheels are automatically raised by the retractable means when the support members are the upper position.

5. The device of claim 3 wherein the forward wheels are automatically moved downward by the means for moving the forward wheels downwardly to engage the support surface when the support members are in the lower transport position.

* * * * *